US006377749B2

(12) United States Patent
Ohmura

(10) Patent No.: US 6,377,749 B2
(45) Date of Patent: Apr. 23, 2002

(54) HAIRDRYER WITH CONCENTRIC NOZZLES

(75) Inventor: Shingo Ohmura, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/900,990

(22) Filed: Jul. 9, 2001

(51) Int. Cl.[7] ..... A45D 20/10

(52) U.S. Cl. ..... 392/385; 34/97; 239/592; 239/424

(58) Field of Search ..... 392/384, 385; 34/96, 97; 239/548, 552, 553, 554, 558, 423–424, 592, 599

(56) References Cited

U.S. PATENT DOCUMENTS 3,088,854 A * 5/1963 Spies, Jr. ..... 239/424
3,219,797 A * 11/1965 Brady ..... 392/379
3,258,578 A * 6/1966 Ferris ..... 392/385
3,365,811 A * 1/1968 Djenner ..... 392/384
3,612,824 A * 10/1971 Berryman et al. ..... 392/383
2001/0025430 A1 * 10/2001 Sakamoto ..... 34/96

FOREIGN PATENT DOCUMENTS

JP 58-143604 9/1983
JP 2000-125921 5/2000

* cited by examiner

*Primary Examiner*—John A. Jeffery
(74) *Attorney, Agent, or Firm*—Rosenthal & Osha L.L.P.

(57) ABSTRACT

The present invention is a hairdryer. The hairdryer includes a housing body which has an opening at a front end thereof and an air intake at a rear end thereof. A handle is disposed at a bottom portion of the housing body. A heater and a fan are disposed within the housing body. An outer nozzle is disposed at its front end of the housing body and forming an outer air outlet opening. An inner nozzle is disposed inside the outer nozzle and forming an inner air outlet opening. The inner nozzle includes an inclined portion and a parallel portion. The inclined portion extends from a predetermined position inside the outer nozzle toward the inner air outlet opening while inclining toward a central axis of the outer nozzle. The parallel portion extends from a front end of the inclined portion toward the inner air outlet opening approximately in parallel with the central axis of the outer nozzle.

14 Claims, 9 Drawing Sheets

HAIRDRYER WITH CONCENTRIC NOZZLES

The present application relates to Japanese Patent Application No. 2000-19138, filed Jan. 27, 2000, entitled "Hair Dryer". The contents of that application are incorporated herein by reference in their entirety.

BACKGROUND OF INVENTION

The present invention relates to a hairdryer.

Generally, a hairdryer is provided with an air outlet opening having a nozzle which controls expellation of heated air through the air outlet opening to perform drying and setting of human hair.

As illustrated in FIG. 9, a conventional hairdryer disclosed by Japanese patent laid open JITSUKAISHOU 58-143604 includes an outer nozzle (9) and an inner nozzle (10) such that an area of the air outlet opening of a nozzle (8) can be controlled.

However, if the area of the opening of the nozzle (8) is narrowed to increase the speed of the heated air, the amount of the air is inevitably decreased, causing loss of air flow. As a result, the kinetic energy of the air is decreased and the thermal energy of the air is increased, thereby causing excessive increase of temperature of the air. This eventually may result in damaging the hair.

In order to solve this problem, it has been proposed that only the air flow around the central axis (x) of the nozzle should be suppressed while the air flow proximate to the circumference of the nozzle (8) is not suppressed so that the speed of the air can be increased without decreasing the amount of the air, and accordingly energy loss of the air can be minimized. However, as in the case of the conventional hairdryer shown in FIG. 9, if the air outlet opening of the inner nozzle (10) is narrowed, the air causes interference at the air outlet region **(10*f*) of an inner nozzle (10)**. Because of this, even under this configuration, loss of air flow cannot be avoided.

SUMMARY OF INVENTION

The present invention is a hairdryer. The hairdryer comprises a housing body which has an opening at a front end thereof and an air intake at a rear end thereof. A handle is disposed at a bottom portion of the housing body. A heater and a fan are disposed within the housing body. An outer nozzle is disposed at the front end of the housing body and forming an outer air outlet opening. An inner nozzle is disposed inside the outer nozzle and forming an inner air outlet opening. The inner nozzle comprises an inclined portion and a parallel portion. The inclined portion extends from a predetermined position inside the outer nozzle toward the inner air outlet opening while inclining toward a central axis of the outer nozzle. The parallel portion extends from a front end of the inclined portion toward the inner air outlet opening approximately in parallel with the central axis of the outer nozzle.

DETAILED DESCRIPTION

Figure 1:
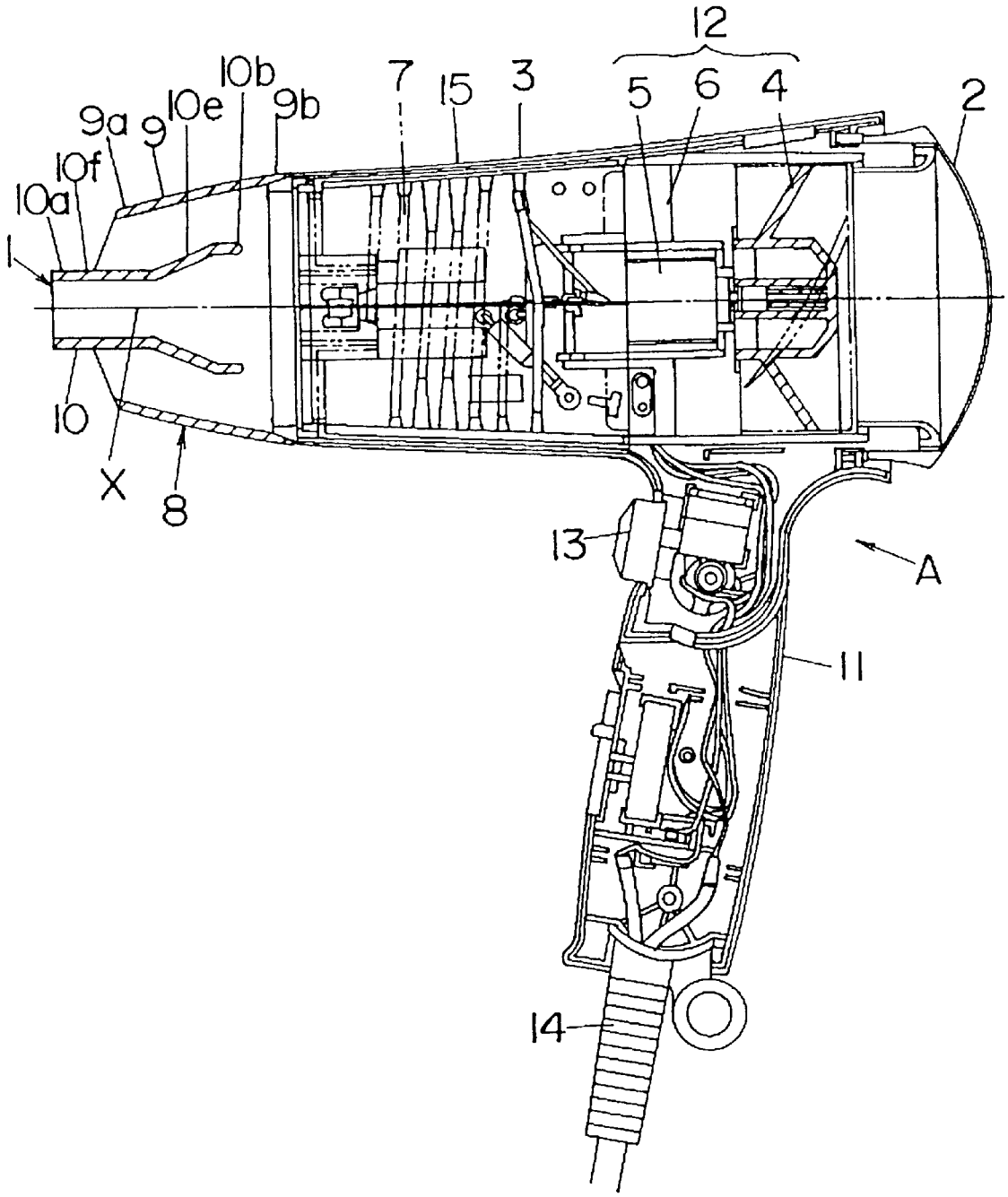
FIG. 1 is a cross-sectional view of an assembled hairdryer according to an embodiment of the present invention.
Figure 2:
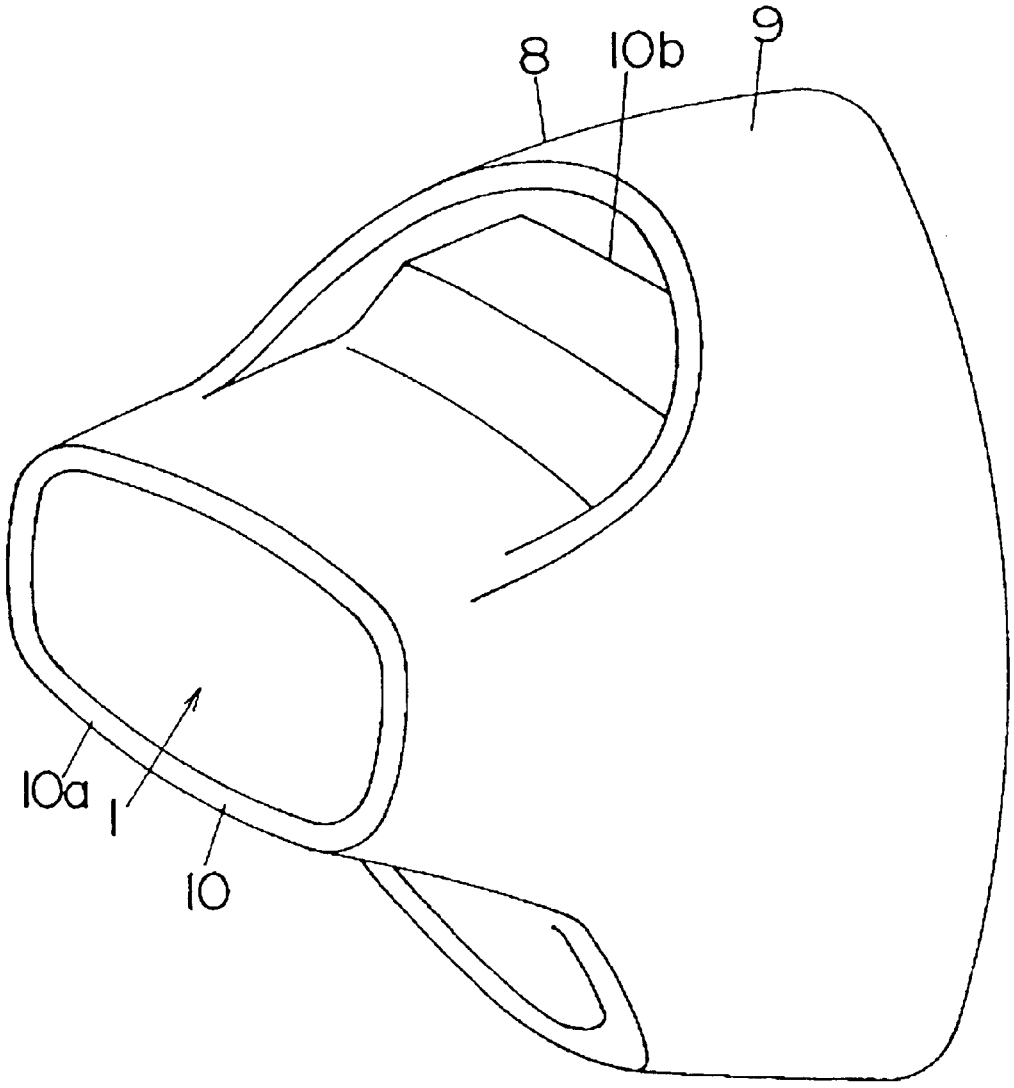
FIG. 2 is a perspective view of a part of the assembled hairdryer according to an embodiment of the present invention.
Figure 3:
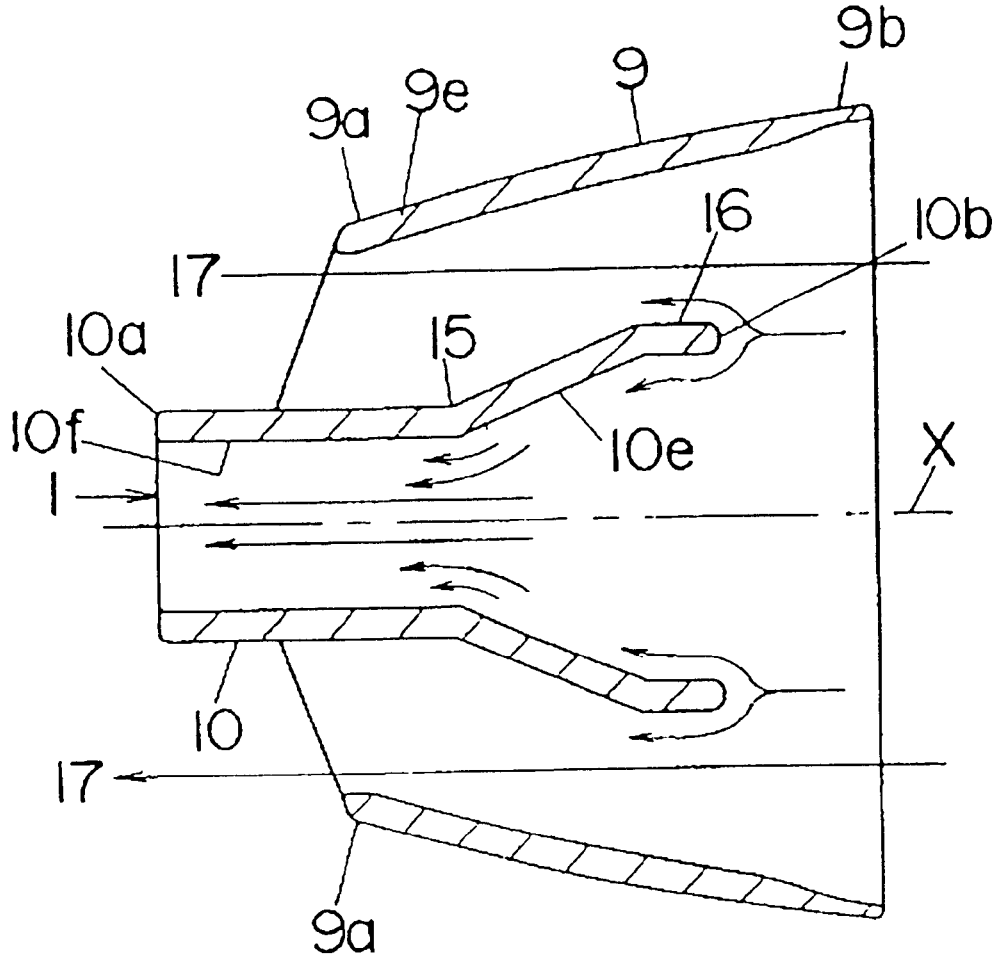
FIG. 3 is a cross-sectional view of the part of the assembled hairdryer as shown in FIG. 2.
Figure 4:
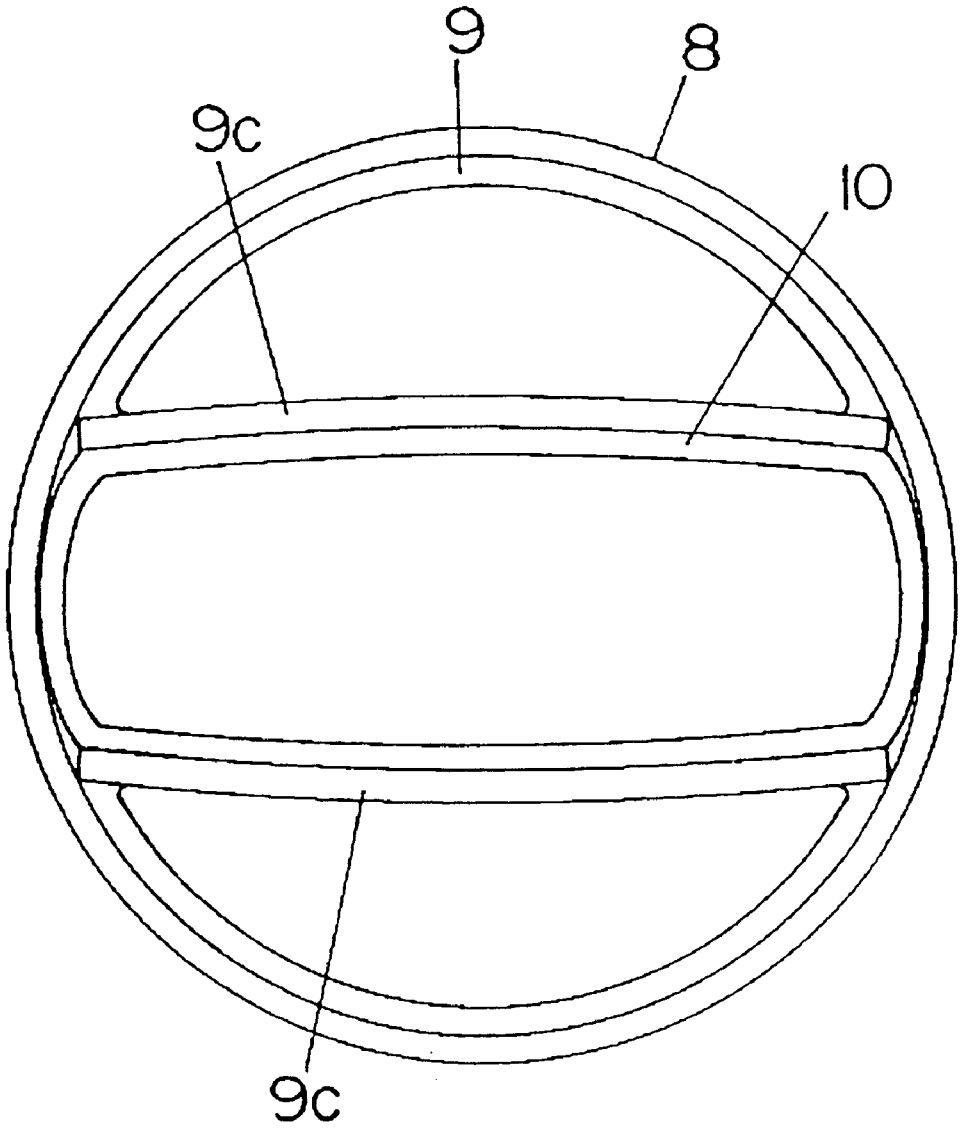
FIG. 4 is a front view of the part shown in FIG. 3.

Referring now to the drawings wherein like reference characters are used for like parts throughout the several views, embodiments of the present invention are explained in detail as follows. FIG. 1 is a cross-sectional view of an embodiment of the present invention. FIG. 2 is a perspective view of a nozzle (8). FIG. 3 is a cross-sectional view of the nozzle (8), and FIG. 4 is a front view of the nozzle (8).

As illustrated in FIG. 1, a cylindrical housing (3) of a hairdryer (A) is provided with an air outlet opening (1) at a front end thereof and an air intake opening (2) at a rear end thereof. The housing (3) of the hairdryer (A) includes a housing body (15) and a nozzle (8) provided at the front end of the housing body (15). The nozzle (8) forms an air outlet opening (1) at the front end thereof. Although the nozzle (8) is formed as separate component that is attached to the housing body (15) in this embodiment, it may be formed as an integral part of the housing body (15). In addition, a handle (11) is provided at a bottom of the rear end portion of the housing body (15) in a manner that it protrudes downward from the bottom of the housing body (15).

Inside the housing body (15), there is provided an air-expelling device (12) which includes a motor (5), a fan (4) driven by the motor (5), and a rectifier circuit (6) used for providing rectified power to the motor (5). Also, at the front-end side of the housing body (15), there is provided a heater (7) for heating the air flow generated by the air-expelling device (12).

The handle (11) includes a switch (13) for controlling the air-expelling device (12) and for switching the heater (7). In addition, an electrical cord (14) is connected to the bottom of the handle (11).

As illustrated in FIG. 2, the nozzle (8) having the air outlet opening (1) has an outer nozzle (9) and an inner nozzle (10) provided inside of the outer nozzle (9).

As shown in FIGS. 3 and 4, the nozzle (8) is formed in an approximately cylindrical shape, the diameter of which becomes gradually smaller as it goes from the rear side to the front side. The outer nozzle (9) joins the inner nozzle (10) at the outer surface of the inner nozzle (10). In the embodiment shown in FIGS. 3 and 4, the outer nozzle (9) has an upper portion and a lower portion, facing toward each other, and the inner nozzle (10) is provided between these two portions. The outer nozzle (9) is interposed by the inner nozzle (10) in a manner that the nozzle piece **(9*c*) of the outer nozzle (9) contacts the outer wall of the inner nozzle (10)**.

Figure 8:
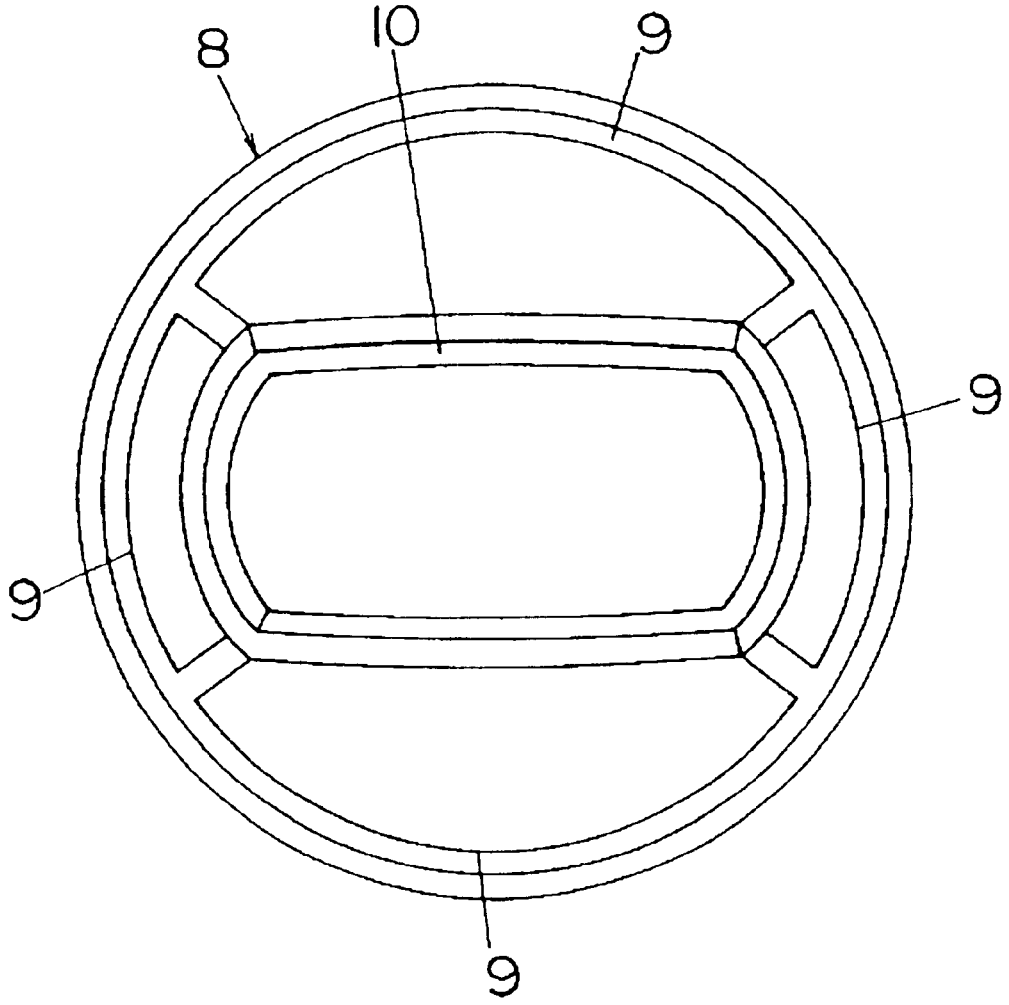
FIG. 8 is a front view of a part of a hairdryer showing another embodiment of the present invention.
Figure 9:
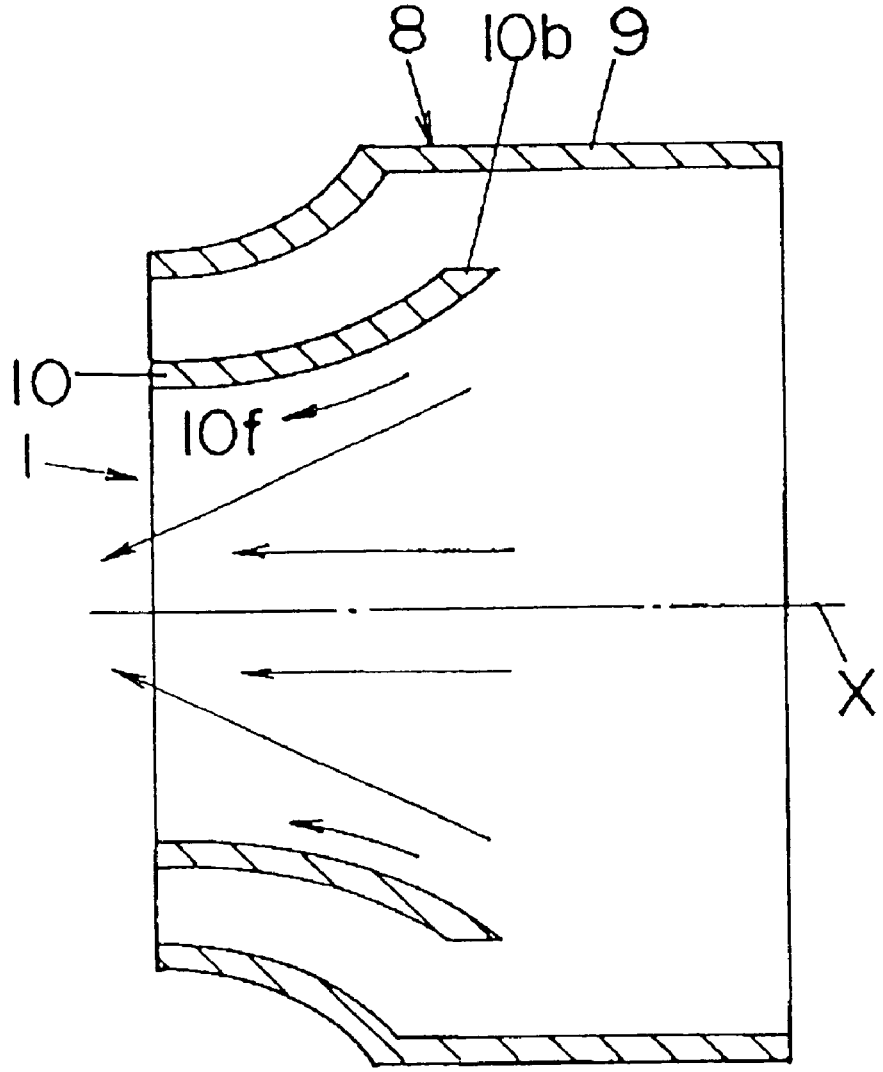
Fig 9 (Prior Art)
FIG. 9 is a cross-sectional view of a part of a conventional hairdryer showing the prior art.

Also, as illustrated in FIG. 8, the nozzle (8) may be formed in a manner that a plurality of outer nozzles (9) encompass the circumference of the inner nozzle (10).

The inner nozzle (10) is formed of an inclined portion **(10*e*) and a parallel portion (10*f*) extending from a front end of the inclined portion. The parallel portion (10*f*) is positioned more frontwardly than the inclined portion (10*e*)**.

If a central axis (x) penetrating through the air outlet opening (1) and the air intake opening (2) is imagined, the inner nozzle (10) is positioned such that the central axis (x) comes inside the inner nozzle (10). Also, as shown in the cross-sectional view of FIG. 3, viewing from an angle that is vertical to the central axis (x), the inclined portion (10*e*) is provided at a frontward area of the housing (3) gradually inclining toward the central axis (x) as it goes frontward. In the region where the inclined portion (10*e*) is provided, the area of the opening of the nozzle (10) is gradually decreased as it goes from the rear end to the front end. Also, the parallel portion (10*f*) that is continuously formed from the front end of the inclined portion (10*e*) is extended toward the air outlet opening approximately in parallel with the central axis (x). In the region where the parallel portion (10*f*) is formed, the shape of the opening of the inner nozzle (10) remains the same throughout that region. Preferably, the bent portion (15) where the inclined portion (10*e*) and the parallel portion (10*f*) are connected to each other should be formed in a manner that the bent portion (15) forms a circle having a predetermined radius so that change of the direction at the bent portion (15) is moderated. By forming these two portions (10*e*, 10*f*) in this manner, radical change of air flow at the area around the bent portion (15) can be avoided.

The inner nozzle (10) is provided in the area that interposes or is surrounded by the outer nozzle (9). In addition, the front end (10*a*) of the inner nozzle (10) protrudes beyond the opening of the outer nozzle (9). Namely, the inner nozzle (10) and the outer nozzle (9) are provided in a manner that they form an overlapping potion along the direction of the central axis (x).

Under this configuration, heated air generated by the air-expelling device (12) and the heater (7) is first oriented toward the central axis (x) along the inclined portion (10*e*), and then oriented approximately in parallel with the central axis (x) along the parallel portion (10*f*) of the inner nozzle (10). At this time, due to the viscous behavior of airflow, the air blowing proximate to the inner wall of the inner nozzle (10) tends to be attracted to the inner wall of the inner nozzle (10). As a result, interference between the air blowing around the central axis (x) of the inner nozzle (10) and the air blowing proximate to the inner wall of the inner nozzle (10) is prevented. Consequently, the air flow inside the inner nozzle (10) becomes smooth, and the direction of the air expelled frontward from the opening of the inner nozzle (10) becomes straight. Because of this, it becomes possible to prevent decrease of the heated air expelled from the nozzle (8) while increasing the speed of the heated air. Also, because heated air is expelled from the outer nozzle (9) in addition to the inner nozzle (10), expellation of a sufficient amount of air can be maintained.

As described above, the inner nozzle (10) and the outer nozzle (9) are provided in a manner that they form an overlapping portion in a direction along the central axis (x). Because of this, by positioning the opening of the inner nozzle (10) and the opening of the outer nozzle (9) close to each other, the air expelled from the outer nozzle (9) and the air expelled from the inner nozzle (10) can be integrally united, and sufficient amount of air can be maintained.

Further, because the front end (10*a*) of the inner nozzle (10) is provided such that it protrudes beyond the air outlet opening of the outer nozzle (9), the overlapping portion between the inner nozzle (10) and the outer nozzle (9) is decreased to that extent. As a result, the structural alteration of the outer nozzle (9) due to the formation of the inner nozzle (10) inside is minimized, and therefore disturbance of the air in the outer nozzle (9) caused by the structural alteration can be prevented. Because of this, despite the existence of the inner nozzle (10), the amount and speed of the air expelled from the outer nozzle (9) can be sufficiently maintained. Also, separation or diffusion of the air expelled from the outer nozzle (9) from the air expelled from the inner nozzle (10) can be prevented. Accordingly, the air expelled from both the outer nozzle (9) and the inner nozzle (10) can be integrally united like a air expelled from a single opening, and the amount of the heated air expelled from the nozzle (8) can be maintained sufficiently.

As described above, the nozzle (8) is formed such that a pair of the outer nozzles (9) are formed in a manner that these two nozzles are opposing to each other and are interposed by the inner nozzle (10). Under this configuration, the opening of the inner nozzle (10) can be easily formed in an approximately rectangular shape as shown in FIG. 4, and therefore, the heated air expelled from the inner nozzle (10) with sufficient amount and speed can be easily blown to a desired position of the hair so that hair setting and drying can be performed efficiently.

The inner nozzle (10) includes an air guide (16). The heated air generated from the air-expelling device (12) and the heater (7) is smoothly divided and sent into each nozzle by this air guide (16). Under this configuration, disturbance of the air inside the nozzle (8) is further prevented and a sufficient amount of the air can be maintained. According to the embodiment shown in FIG. 3, the air guide (16) is formed at the rear end of the inclined portion (10*e*) extending rearward in parallel with the imaginary central axis (x). Under this configuration, the heated air is efficiently guided into the two nozzles, and the disturbance of the air is prevented effectively.

The outer nozzle (9) includes an oblique portion (9*e*) formed at the front end (9*a*) of the outer nozzle (9) inclining toward the central axis (x). According to the embodiment shown in FIG. 3, the entire body of the outer nozzle (9) is inclined toward the central axis (x). The front end (9*a*) of the outer nozzle (9) is formed as the oblique portion (9*e*). If the opening of the inner nozzle (10) is narrowed, the area of the air outlet opening of the outer nozzle (9) widens. As a result, the amount of the air blowing in the outer nozzle (9) increases while the amount of the air blowing in the inner nozzle (10) decreases. By providing the oblique portion (9*e*) at the front end of the nozzle (9), widening of the air outlet opening of the outer nozzle (9) is prevented so that resistance against the air into the outer nozzle (9) can be maintained properly. Under this configuration, excessive increase of the air in the outer nozzle (9) can be avoided. Because of this, the amount of the air in the inner nozzle (10) can be maintained properly, and the amount and speed of the heated air expelled from the nozzle (8) can be increased.

Further, as illustrated in FIG. 3, the front end (9*a*) of the outer nozzle (9) is positioned more frontwardly than the rear end (10*b*) of the inner nozzle (10). Under this configuration, an air passage (17) in the outer nozzle running in parallel with the central axis (x) is secured without being obstructed by the inner wall of the nozzle (8). As a result, radical decrease of the air in the outer nozzle (9) is prevented and therefore decrease of the total amount of the air expelled from the nozzle (8) can be avoided. Especially when the inclined portion (10*e*) is formed to control the amount of the air in the outer nozzle (9), securing the air passage (17) in the outer nozzle (9) is important for preventing radical decrease of the air in the outer nozzle (9).

Figure 7:
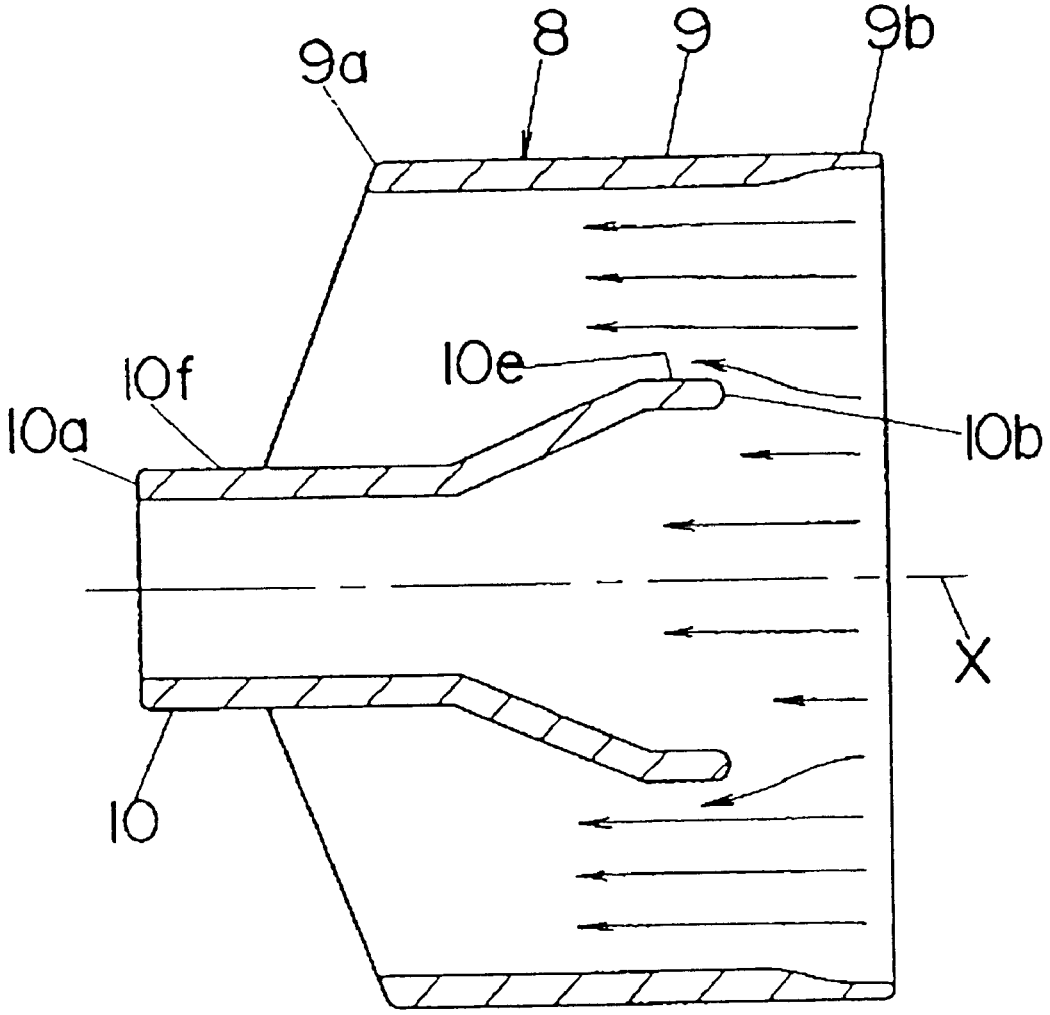
FIG. 7 is a cross-sectional view of a part of a hairdryer showing another embodiment of the present invention.

As shown in FIG. 7, in some embodiments, the outer nozzle (9) can be formed approximately in parallel with the central axis (x) without having the inclined portion (9*e*).

Figure 5:
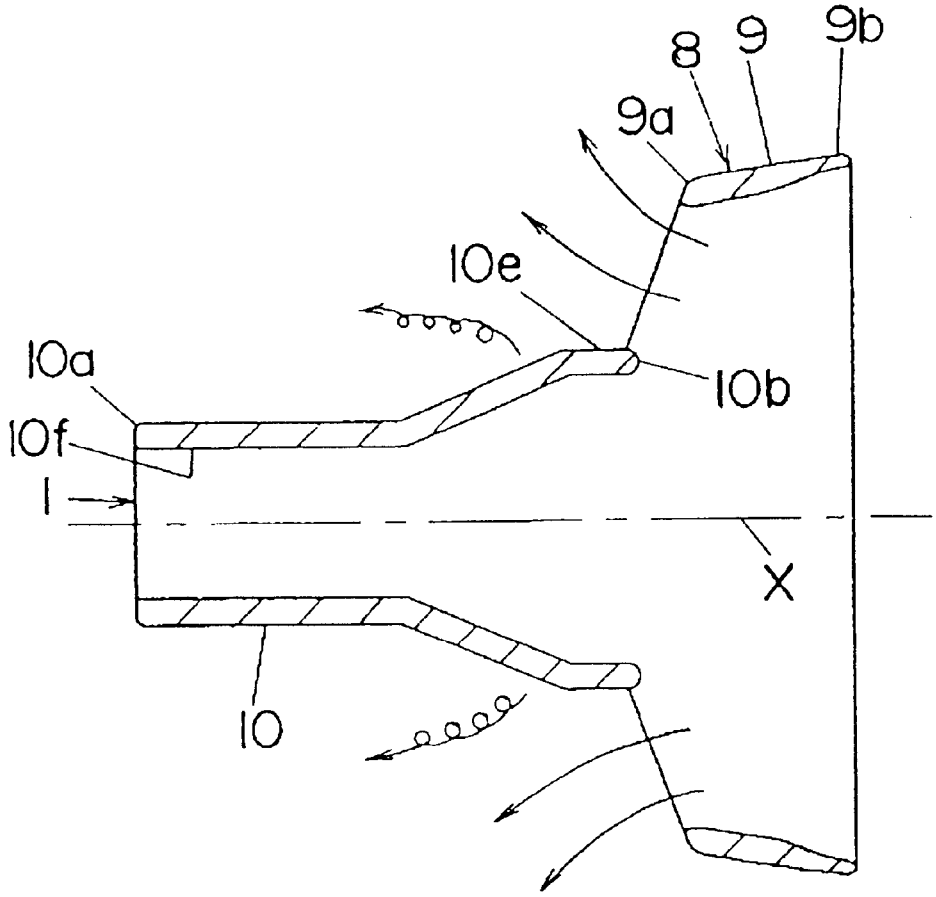
FIG. 5 is a cross-sectional view of an important part of an embodiment of the present invention.
Figure 6:
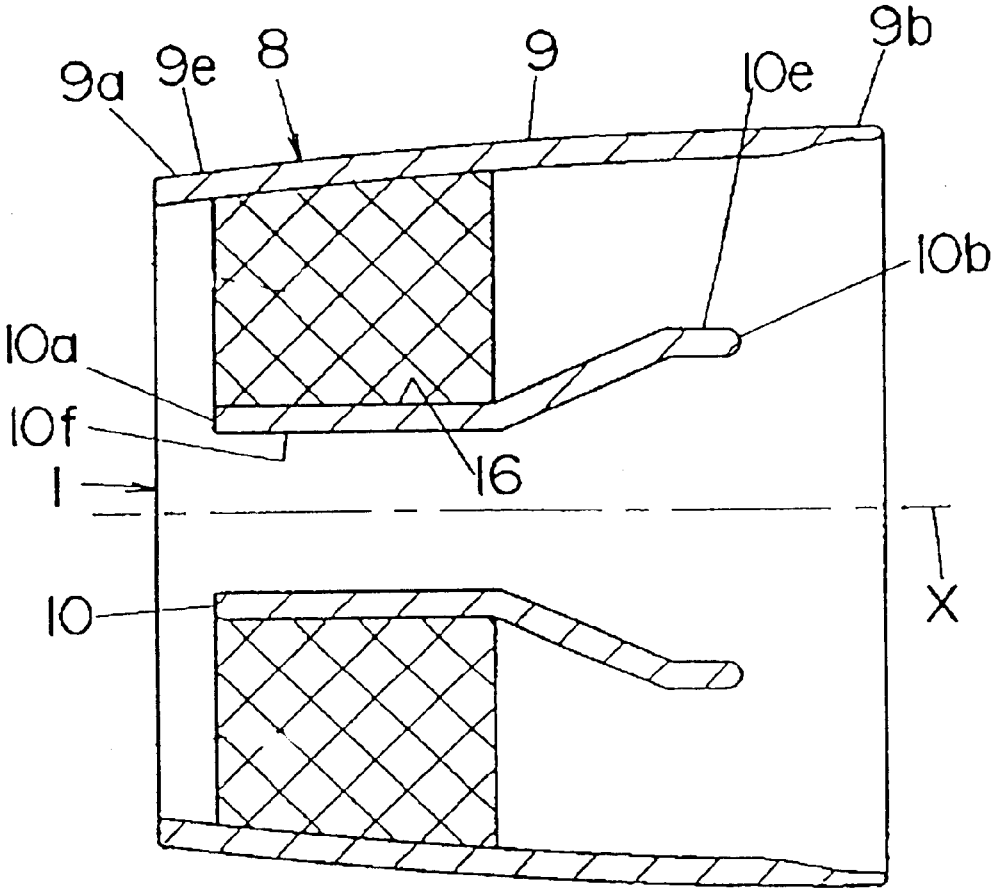
FIG. 6 is a cross-sectional view of a part of a hairdryer showing another embodiment of the present invention.

As shown in FIG. 5, in some embodiments, the rear end of the inner nozzle (10) may be provided at a more frontward position than the front end (9*a*) of the outside nozzle (9) so that there is no overlap between the inner nozzle (10) and the outer nozzle (9). Further, in some embodiments, as shown in FIG. 6, the front end (10*a*) of the inner nozzle (10) can be formed more rearwardly than the front end (9*a*) of the outer nozzle (9).

As described above, a hair dryer according to embodiments of the invention includes a housing body having an air outlet nozzle at a front end thereof forming an air outlet opening, and an air intake opening at a rear end thereof. The air outlet nozzle is formed of an inner nozzle and an outer nozzle. Further, the inner nozzle includes an inclined portion inclining toward the central axis of the nozzle while extending frontward, and a parallel portion formed in parallel with the central axis of the nozzle and connected to the front end of the inclined portion. Under this configuration, because the heated air is expelled from the inner nozzle and outer nozzle respectively, and also the inner nozzle narrows the air passage of the heated air without causing disturbance of the air, it becomes possible to increase the speed of the air without decreasing the amount of the air. In addition, because of the expellation of the air from the outer nozzle (9), the total amount of the air expelled from the nozzle (8) can be maintained. As a result, it becomes possible to increase the speed of the heated air expelled from the nozzle without excessively increasing the temperature of the air and while maintaining a sufficient amount of air.

According to another embodiment of the present invention, in addition to the above described configuration, the inner nozzle and the outer nozzle may overlap each other along the direction of the central axis. Under this configuration, the heated air expelled from the inner nozzle and the outer nozzle can be integrally united so that sufficient amount and speed of the air can be maintained.

According to another embodiment of the present invention, in addition to the above described configuration, the front end of the inner nozzle may be positioned more frontwardly than the front end of the outer nozzle, and the rear end of the inner nozzle may be positioned more rearwardly than the front end of the outer nozzle. Under this configuration, structural alteration caused by providing the inner nozzle can be minimized so that disturbance or diffusion of heated air expelled from the outer nozzle is prevented. As a result, the amount and speed of the heated air expelled from the outer nozzle can be sufficiently maintained. Also, the heated air expelled from the inner nozzle and the outer nozzle can be further integrally united so that a sufficient amount of the heated air can be maintained.

According to another embodiment of the present invention, in addition to the above described configuration, the inner nozzle may be provided between a pair of the outer nozzles, wherein the two outer nozzles are facing each other. Under this configuration, the opening of the inner nozzle can be easily formed in a rectangular shape having longer width in a horizontal direction. This rectangular shaped opening of the inner nozzle is particularly useful for blowing the heated air to human hair at a desired position thereof with sufficient amount and speed of the air. As a result, efficient hair setting and drying can be performed.

According to another embodiment of the present invention, in addition to the above described configuration, the inner nozzle includes an air guide. The air guide can prevent the disturbance of the air and maintain sufficient amount of the air as well as prevent excessive heating of the air.

According to another embodiment of the present invention, in addition to the above described configuration, an air guide is provided at the rear end of the inner nozzle in a direction approximately in parallel with the central axis of the nozzle. Under this configuration, heated air can be smoothly divided into the inner nozzle and the outer nozzle. As a result, increase of temperature and disturbance of the air can be prevented so that sufficient amount of air can be maintained.

According to another embodiment of the present invention, in addition to the above described configuration, an oblique portion is provided at the front end of outer nozzle, inclining toward the central axis of the nozzle. Under this configuration, widening of the opening of the outer nozzle caused by narrowing the opening of the inner nozzle is prevented by the oblique portion provided at the front end of the outer nozzle. By keeping the air resistance against the outer nozzle by providing the oblique portion, excessive air flow into the outer nozzle can be prevented and, thereby, sufficient amount of air in the inner nozzle can be maintained.

According to another embodiment of the present invention, in addition to the above described configuration, the front end of the outer nozzle is positioned more frontwardly than the rear end of the inner nozzle. Under this configuration, an air passage is secured inside the outer nozzle along the central axis of the nozzle without being obstructed by the internal structure of the outer nozzle. As a result, disturbance of air in the outer nozzle is further prevented.

Although the description above contains many specific examples, these should not be construed as limiting the scope of the invention but as merely providing illustrations of some of the embodiments of this invention. Thus, the scope of the invention should be determined by the appended claims and their legal equivalents, rather than by the examples given.

What is claimed is:

1. A hairdryer comprising:

a housing body having an opening at a front end thereof and an air intake at a rear end thereof;

a handle disposed at a bottom portion of the housing body;

a heater and a fan disposed within the housing body;

an outer nozzle disposed at the front end of the housing body and forming an outer air outlet opening; and an inner nozzle disposed inside the outer nozzle and forming an inner air outlet opening;

wherein the inner nozzle comprises an inclined portion and a parallel portion, the inclined portion extending from a predetermined position inside the outer nozzle toward the inner air outlet opening while inclining toward a central axis of the outer nozzle, and wherein the parallel portion extends from a front end of the inclined portion toward the inner air outlet opening approximately in parallel with the central axis of the outer nozzle.

2. The hairdryer according to claim 1, wherein the outer nozzle and the inner nozzle are disposed in a manner that the inner nozzle overlaps the outer nozzle in a direction along the central axis of the outer nozzle.

3. The hairdryer according to claim 2, wherein the outer nozzle is formed in a pair such that these two nozzles are opposing each other and are interposed by the inner nozzle.

4. The hairdryer according to claim 2, wherein an air guide is disposed at a rear end of the inner nozzle approximately in parallel with the central axis of the nozzle.

5. The hairdryer according to claim 2, wherein an oblique portion is disposed at a front end of the outer nozzle and inclines toward the central axis of the outer nozzle.

6. The hairdryer according to claim 2, wherein the front end of the outer nozzle is disposed more rearward than the rear end of the inner nozzle.

7. The hairdryer according to claim 1, wherein a front end of the inner nozzle is disposed frontward of the front end of the outer nozzle, and a rear end of the inner nozzle is positioned rearward of the front end of the outer nozzle.

8. The hairdryer according to claim 1, wherein the outer nozzle is formed in a pair such that these two nozzles are opposing each other and are interposed by the inner nozzle.

9. The hairdryer according to claim 8, wherein an air guide is disposed at a rear end of the inner nozzle approximately in parallel with the central axis of the nozzle.

10. The hairdryer according to claim 1, wherein an air guide is disposed at a rear end of the inner nozzle approximately in parallel with the central axis of the nozzle.

11. The hairdryer according to claim 1, wherein an oblique portion is disposed at a front end of the outer nozzle and inclines toward the central axis of the outer nozzle.

12. The hairdryer according to claim 1, wherein the front end of the outer nozzle is disposed more rearward than the rear end of the inner nozzle.

13. A nozzle of a hair dryer comprising:

an outer nozzle disposed at a front end of a housing body of the hair dryer and forming an outer air outlet opening; and an inner nozzle disposed inside the outer nozzle and forming an inner air outlet opening, wherein the inner nozzle comprises an inclined portion and a parallel portion, the inclined portion extending from a predetermined position inside the outer nozzle toward the inner air outlet opening while inclining toward a central axis of the outer nozzle, and wherein the parallel portion extends from a front end of the inclined portion toward the inner air outlet opening approximately in parallel with the central axis of the outer nozzle.

14. The nozzle according to claim 13, wherein a pair of outer nozzles is formed in a manner that these two nozzles are opposing each other and are interposed by the inner nozzle.

* * * * *